US007323819B2

(12) United States Patent
Hong et al.

(10) Patent No.: US 7,323,819 B2
(45) Date of Patent: Jan. 29, 2008

(54) PLASMA DISPLAY PANEL HAVING HIGH BRIGHTNESS AND HIGH CONTRAST USING LIGHT ABSORPTION REFLECTION FILM

(75) Inventors: Chong-Gi Hong, Asan-si (KR); Tae-Kyoung Kang, Asan-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 318 days.

(21) Appl. No.: 10/965,225

(22) Filed: Oct. 15, 2004

(65) Prior Publication Data

US 2005/0104518 A1 May 19, 2005

(30) Foreign Application Priority Data

Oct. 21, 2003 (KR) ..... 10-2003-0073423

(51) Int. Cl.
*H01J 17/49* (2006.01)

(52) U.S. Cl. ..... 313/584; 313/582; 313/585; 313/586; 313/587

(58) Field of Classification Search ..... 313/582–587
See application file for complete search history.

(56) References Cited

U.S. PATENT DOCUMENTS 5,541,618 A 7/1996 Shinoda
5,661,500 A 8/1997 Shinoda et al.

(Continued)

FOREIGN PATENT DOCUMENTS

JP 02-148645 6/1990

(Continued)

OTHER PUBLICATIONS

"*Final Draft International Standard*", Project No. 47C/61988-1/Ed.1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Mariceli Santiago
(74) *Attorney, Agent, or Firm*—Robert E. Bushnell, Esq.

(57) ABSTRACT

A plasma display panel having a light absorption reflection film that does not reflect light emitted from a discharge space in a non-discharge region includes: a rear substrate; a plurality of address electrodes arranged on a surface of the rear substrate; a rear dielectric layer arranged on the rear substrate to cover the address electrodes; a plurality of barrier ribs arranged on the rear dielectric layer to define discharge cells; a front substrate facing the rear substrate; a plurality of sustaining electrode pairs composed of X and Y electrodes; a light absorption reflection film including a first light absorption reflection film arranged between the adjacent sustaining electrode pairs and a second light absorption reflection film having a different width than that of the first light absorption reflection film, the second light absorption reflection film arranged on a lower surface of the first light absorption reflection film; and a front dielectric layer arranged on a lower surface of the front substrate to cover the X and Y electrodes and the light absorption reflection film.

13 Claims, 10 Drawing Sheets

U.S. PATENT DOCUMENTS

| | | | | |
|---|---|---|---|---|
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| 6,297,590 | B1 * | 10/2001 | Nanto et al. | 313/586 |
| RE37,444 | E | 11/2001 | Kanazawa | |
| 6,417,620 | B1 * | 7/2002 | Yasue | 313/587 |
| 6,630,916 | B1 | 10/2003 | Shinoda | |
| 6,707,436 | B2 | 3/2004 | Setoguchi et al. | |
| 2002/0167275 | A1 * | 11/2002 | Bechtel et al. | 313/587 |
| 2004/0000871 | A1 * | 1/2004 | Higashi et al. | 313/582 |
| 2005/0236987 | A1 * | 10/2005 | Okazaki et al. | 313/582 |

FOREIGN PATENT DOCUMENTS

| | | | |
|---|---|---|---|
| JP | 09245627 | A * | 9/1997 |
| JP | 2845183 | | 10/1998 |
| JP | 10269951 | A * | 10/1998 |
| JP | 10312754 | A * | 11/1998 |
| JP | 2917279 | | 4/1999 |
| JP | 11339670 | A * | 12/1999 |
| JP | 2001-331619 | | 11/2000 |
| JP | 2001-043804 | | 2/2001 |
| JP | 2001-325888 | | 11/2001 |
| JP | 2002170493 | A * | 6/2002 |
| JP | 2003203570 | A * | 7/2003 |
| KR | 10-2001-0038965 | | 5/2001 |
| KR | 2001039032 | A * | 5/2001 |

OTHER PUBLICATIONS

Korean Office Action of the Korean Patent Application No. 2003-73423, issued on Mar. 27, 2006.

* cited by examiner

PLASMA DISPLAY PANEL HAVING HIGH BRIGHTNESS AND HIGH CONTRAST USING LIGHT ABSORPTION REFLECTION FILM

CLAIM OF PRIORITY

This application makes reference to, incorporates the same herein, and claims all benefits accruing under 35 U.S.C. § 119 from an application for PLASMA DISPLAY PANEL HAVING HIGH BRIGHTNESS AND HIGH CONTRAST earlier filed in the Korean Intellectual Property Office on 21 Oct. 2003 and there duly assigned Serial No. 2003-73423.

BACKGROUND OF THE INVENTION

1. Field of the Invention

The present invention relates to a plasma display panel, and more particularly, to a plasma display panel having a front substrate with a structure to improve brightness and maintain a high contrast.

2. Description of the Related Art

A plasma display panel, generally considered to be a display device that will replace conventional cathode ray tubes, obtains an image by exciting a fluorescent material arranged in a predetermined pattern with ultraviolet rays generated by a discharge gas sealed in a space formed by two substrates on which a plurality of electrodes are formed, the electrodes applying a voltage therebetween.

The plasma display panel can be divided into direct current plasma display panels and alternating current plasma display panels according to the type of discharge. At least one electrode is covered by a dielectric layer in the alternating current plasma display panel, and a discharge is performed by a field of a wall charge instead of a direct migration of charges between corresponding electrodes.

An alternating current plasma display panel comprises a front substrate on which an image is displayed and a rear substrate facing the front substrate. Pairs of X and Y electrodes are disposed on the front substrate, and address electrodes crossing the X and Y electrodes are disposed on a surface of the rear substrate facing the front substrate. The X and Y electrodes on the front substrate form a sustaining electrode pair. The sustaining electrode pair is formed of pairs of transparent electrodes, made of a material such as Indium Tin Oxide (ITO), and bus electrodes with a narrow width, formed of a metal, are disposed on a lower surface of the pairs of transparent electrodes to reduce line resistance. The sustaining electrode pair can be formed of only the bus electrodes or the transparent electrodes. The sustaining electrode pair composed of the X and Y electrodes and the crossing address electrodes form a unit discharge cell.

A front dielectric layer and a rear dielectric layer are respectively arranged on each surface of the front substrate having the X and Y electrodes and the rear substrate having the address electrodes. A protective layer of MgO is arranged on the front dielectric layer, and a plurality of barrier ribs to maintain a discharge distance and to prevent electrical and optical cross-talk between the discharge cells are arranged on the rear dielectric layer. Red, green, and blue fluorescent materials are coated on both sides of the barrier ribs and on an upper surface of the rear dielectric layer on which the barrier ribs are not arranged.

The plasma display panel having the above structure is operated in the following manner. When a discharge cell is selected, a predetermined voltage is applied to the address electrode and the Y electrode in the discharge cell to cause an address discharge between the two electrodes, and then, a wall charge is formed on the front dielectric layer. Afterwards, when a predetermined voltage is applied between the X and Y electrodes, a sustaining discharge occurs in the discharge gas due to migrating wall charges between the two electrodes, generating ultraviolet rays, and an image is displayed from the excited fluorescent material by the ultraviolet rays.

However, because the bus electrodes are not arranged in the non-discharge region of the plasma display panel, contrast is reduced due to reflection of external light infiltrated into the plasma display panel through a non-discharge region.

To solve this problem, the plasma display panel disclosed in Korean Patent Publication No. 2000-0009235, uses a light absorption reflection film arranged between the sustain electrode pairs. The light absorption reflection film, including a black material, is arranged between the discharge cells. Accordingly, the contrast increases since external light is absorbed by the light absorption reflection film in the non-discharge region. However, brightness is reduced since the light absorption reflection film absorbs visible light emitted from the discharge space because it is black. This problem becomes more severe as the width of the light absorption reflection film is increased to further increase the contrast.

SUMMARY OF THE INVENTION

The present invention provides a plasma display panel having a light absorption reflection film that does not reflect external light infiltrated into the plasma display panel and efficiently reflects visible light emitted from a discharge space.

According to one embodiment of the present invention, a plasma display panel is provided comprising: a rear substrate; a plurality of address electrodes arranged on a surface of the rear substrate; a rear dielectric layer arranged on the rear substrate to cover the address electrodes; a plurality of barrier ribs adapted to define discharge cells, the plurality of barrier ribs arranged on an upper portion of the rear dielectric layer; a fluorescent material adapted to coat an inner surface of the discharge cells; a front substrate arranged to face the rear substrate; a plurality of sustain electrode pairs, each pair composed of X and Y electrodes adapted to form unit discharge cells and to cross the address electrodes and arranged on a lower surface of the front substrate; a light absorption reflection film including a first light absorption reflection film arranged between adjacent sustain electrode pairs on a lower surface of the front substrate and a second light absorption reflection film having a different width than that of the first light absorption reflection film, the second light absorption reflection film arranged on a lower surface of the first light absorption reflection film; and a front dielectric layer arranged on a lower surface of the front substrate to cover the X and Y electrodes and the light absorption reflection film.

The first light absorption reflection film and the second light absorption reflection film are preferably arranged to have a stair shape having a step difference.

When the greater of the widths of the first and second light absorption reflection films is A and the narrower width is B, a value of $(A-B)/A\times100$ is preferably in a range of 5-70.

A width of the light absorption reflection film is preferably gradually increased from an upper surface of the first light absorption reflection film to a lower surface of the second light absorption reflection film.

Side surfaces of the light absorption reflection film preferably have a slope angle in a range of 5-80° with respect to the lower surface of the front substrate, and when the greater of the widths of the first and the second light absorption reflection films is A, and the narrower width is B, the value of (A−B)/A×100 is preferably in a range of 5-70.

Center lines of the first light absorption reflection film and the second light absorption reflection film are preferably equal.

The first and second light absorption reflection films are preferably black.

According to another embodiment of the present invention, a plasma display panel is provided comprising: a rear substrate; a plurality of address electrodes arranged on a surface of the rear substrate; a rear dielectric layer arranged on the rear substrate to cover the address electrodes; a plurality of barrier ribs adapted to define discharge cells, the plurality of barrier ribs arranged on an upper portion of the rear dielectric layer; a fluorescent material adapted to coat an inner surface of the discharge cells; a front substrate arranged to face the rear substrate; a plurality of sustain electrode pairs, each pair composed of X and Y electrodes adapted to form unit discharge cells and to cross the address electrodes and arranged on a lower surface of the front substrate; a light absorption reflection film including a first light absorption reflection film arranged between adjacent sustain electrode pairs on a lower surface of the front substrate and a second light absorption reflection film having a different width than that of the first light absorption reflection film and composed of a material having a higher reflectance than that of the first light absorption reflection film, the second light absorption reflection film arranged on a lower surface of the first light absorption reflection film; and a front dielectric layer arranged on a lower surface of the front substrate to cover the X and Y electrodes and the light absorption reflection film.

The first light absorption reflection film and the second light absorption reflection film are preferably arranged to have a stair shape having a step difference.

When the greater of the widths of the first and second light absorption reflection films is A and the narrower width is B, a value of (A−B)/A×100 is preferably in a range of 5-70.

A width of the light absorption reflection film is preferably gradually increased from an upper surface of the first light absorption reflection film to a lower surface of the second light absorption reflection film.

Side surfaces of the light absorption reflection film preferably have a slope angle in a range of 5~80° with respect to the lower surface of the front substrate, and when the greater of the widths of the first and the second light absorption reflection films is A, and the narrower width is B, the value of (A−B)/A×100 is preferably in a range of 5-70.

Center lines of the first light absorption reflection film and the second light absorption reflection film are preferably equal.

The first light absorption reflection film preferably includes more than one metal selected from the group consisting of Ru, Mn, Ni, Cr, Fe, and Co, and the second light absorption reflection film preferably includes $TiO_2$.

The first light absorption reflection film is preferably black and the second light absorption reflection film is preferably white.

According to still another embodiment of the present invention, a plasma display panel is provided comprising: a rear substrate; a plurality of address electrodes arranged on a surface of the rear substrate; a rear dielectric layer arranged on the rear substrate to cover the address electrodes; a plurality of barrier ribs adapted to define discharge cells, the plurality of barrier ribs arranged on an upper portion of the rear dielectric layer; a fluorescent material adapted to coat an inner surface of the discharge cells; a front substrate arranged to face the rear substrate; a plurality of sustain electrode pairs, each pair composed of X and Y electrodes adapted to form unit discharge cells and to cross the address electrodes and arranged on a lower surface of the front substrate; a front dielectric layer arranged on a lower surface of the front substrate to cover the sustain electrode pairs; and a light absorption reflection film including a first light absorption reflection film arranged between the adjacent sustain electrode pairs on a lower surface of the front dielectric layer and a second light absorption reflection film having a different width than that of the first light absorption reflection film, the second light absorption reflection film arranged on a lower surface of the first light absorption reflection film.

The first light absorption reflection film and the second light absorption reflection film are preferably arranged to have a stair shape having a step difference.

When the greater of the widths of the first and second light absorption reflection films is A and the narrower width is B, a value of (A−B)/A×100 is preferably in a range of 5-70.

A width of the light absorption reflection film is preferably gradually increased from an upper surface of the first light absorption reflection film to a lower surface of the second light absorption reflection film.

Side surfaces of the light absorption reflection film preferably have a slope angle in a range of 5-80° with respect to the lower surface of the front substrate, and when the greater of the widths of the first and the second light absorption reflection films is A, and the narrower width is B, the value of (A−B)/A×100 is preferably in a range of 5-70.

Center lines of the first light absorption reflection film and the second light absorption reflection film are preferably equal.

The first light absorption reflection film preferably includes more than one metal selected from the group consisting of Ru, Mn, Ni, Cr, Fe, and Co, and the second light absorption reflection film preferably includes $TiO_2$.

The first light absorption reflection film and the second light absorption reflection film are preferably black.

According to yet another embodiment of the present invention, a plasma display panel is provided comprising: a rear substrate; a plurality of address electrodes arranged on a surface of the rear substrate; a rear dielectric layer arranged on the rear substrate to cover the address electrodes; a plurality of barrier ribs adapted to define discharge cells, the plurality of barrier ribs arranged on an upper portion of the rear dielectric layer; a fluorescent material adapted to coat an inner surface of the discharge cells; a front substrate arranged to face the rear substrate; a plurality of sustain electrode pairs, each pair composed of X and Y electrodes adapted to form unit discharge cells and to cross the address electrodes and arranged on a lower surface of the front substrate; a light absorption reflection film undercut such that a width of a lower surface is narrower than that of an upper surface contacting the front substrate, the light absorption reflection film arranged between adjacent sustain electrode pairs on a lower surface of the front substrate; and a front dielectric layer arranged on a lower surface of the front substrate to cover the X and Y electrodes and the light absorption reflection film.

Side surfaces of the light absorption reflection film preferably have a slope angle in a range of 5-80° with respect to the lower surface of the front substrate, and when the lower surface of the light absorption reflection films is A and the upper surface of the light absorption reflection film is B, the value of (A−B)/A×100 is preferably in a range of 5-70.

The light absorption reflection film is preferably a single layer undercut such that a width of the light absorption reflection film is gradually decreased from an upper surface of the first light absorption reflection film to a lower surface of the second light absorption reflection film.

According to yet sill another embodiment of the present invention, a plasma display panel is provided comprising: a rear substrate; a plurality of address electrodes arranged on a surface of the rear substrate; a rear dielectric layer arranged on the rear substrate to cover the address electrodes; a plurality of barrier ribs adapted to define discharge cells, the plurality of barrier ribs arranged on an upper portion of the rear dielectric layer; a fluorescent material adapted to coat an inner surface of the discharge cells; a front substrate arranged to face the rear substrate; a plurality of sustain electrode pairs, each pair composed of X and Y electrodes adapted to form unit discharge cells and to cross the address electrodes and arranged on a lower surface of the front substrate; a front dielectric layer arranged on a lower surface of the front substrate to cover the sustain electrode pairs; and a light absorption reflection film undercut such that a width of an upper surface, contacting the front dielectric layer is narrower than that of a lower surface, the light absorption reflection film arranged between adjacent sustain electrode pairs on a lower surface of the front substrate.

Side surfaces of the light absorption reflection film preferably have a slope angle in a range of 5-80° with respect to the lower surface of the front dielectric layer, and when the lower surface of the light absorption reflection film is A and the upper surface of the light absorption reflection film is B, the value of (A−B)/A×100 is preferably in a range of 5-70.

The light absorption reflection film is preferably a single layer undercut such that the a width of the light absorption reflection film is gradually increased from an upper surface of the first light absorption reflection film to a lower surface of the second light absorption reflection film.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
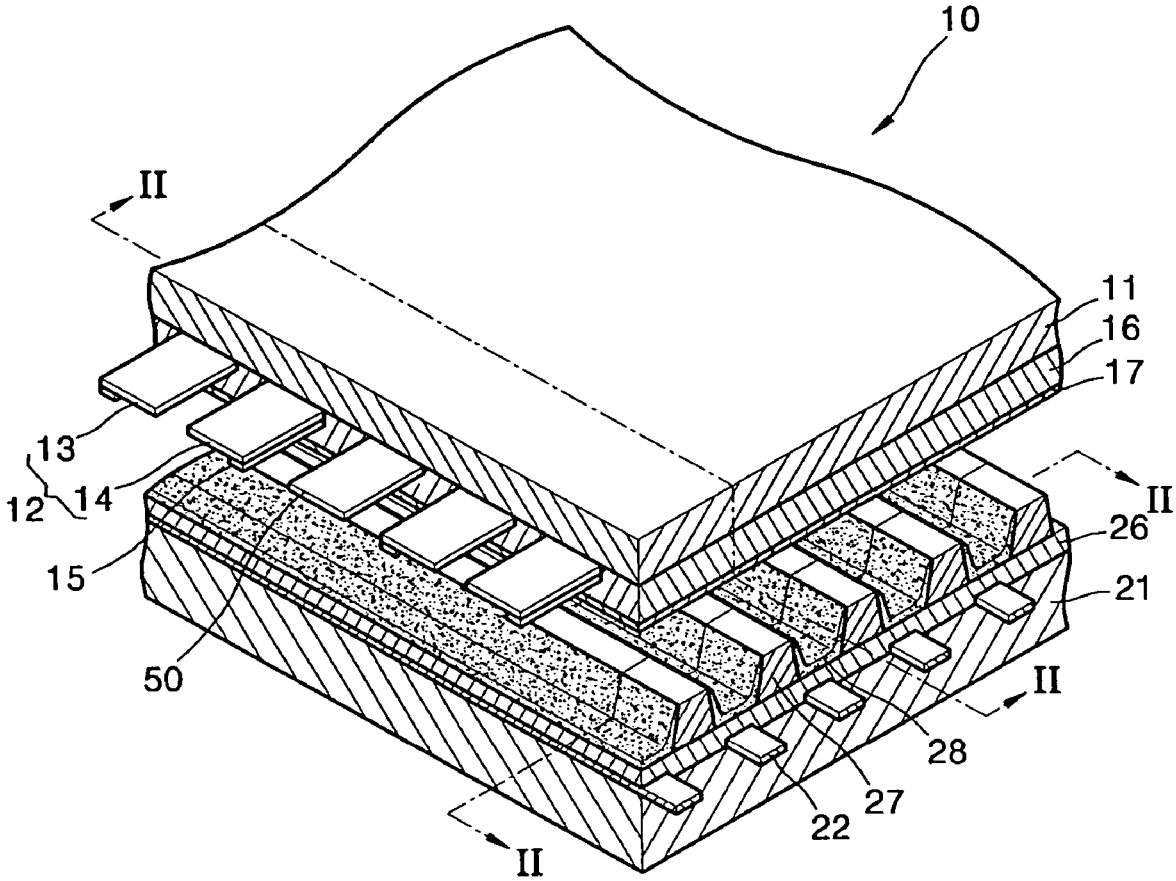
FIG. 1 is a perspective view of a plasma display panel.
Figure 2:
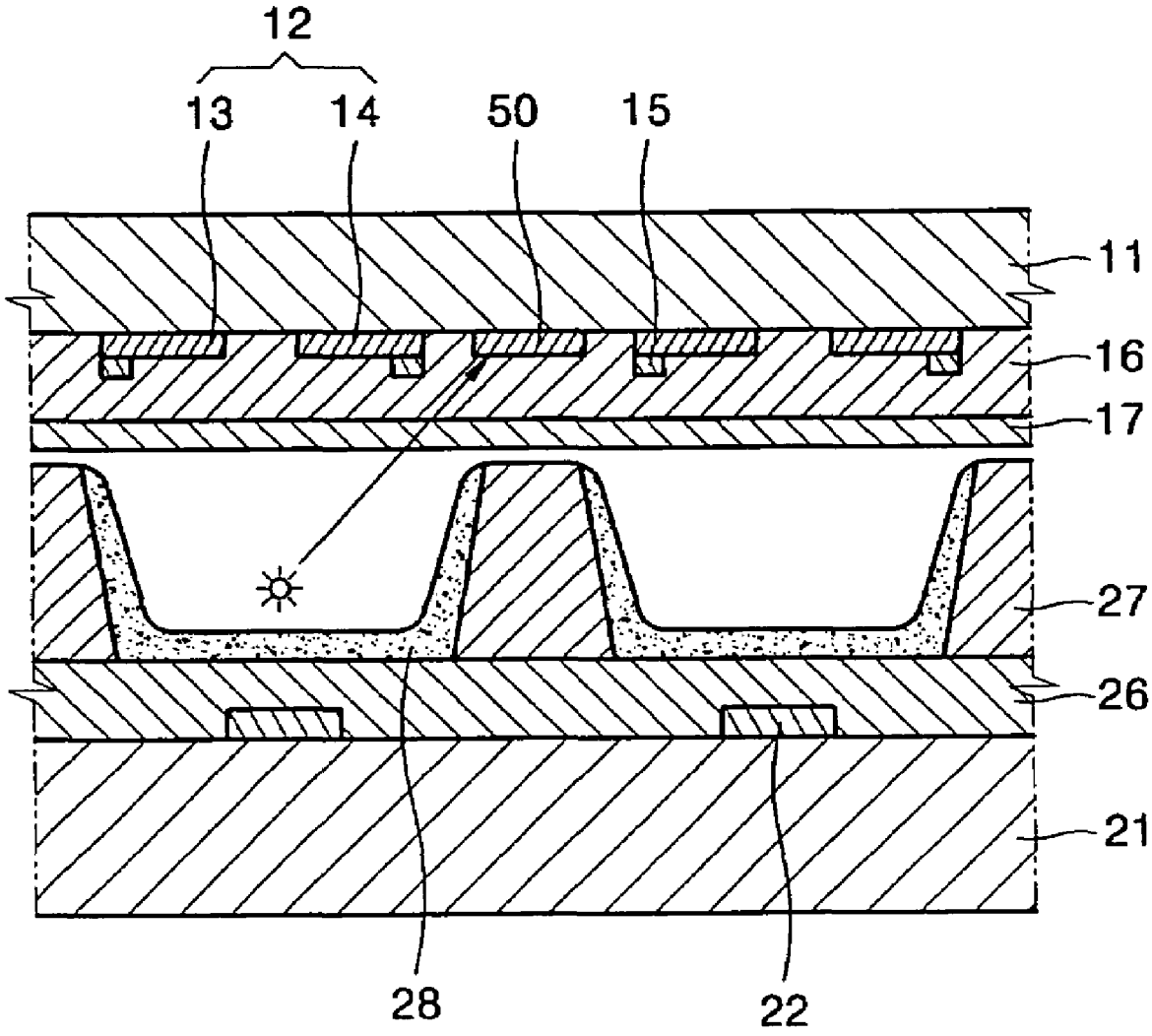
FIG. 2 is a cross-sectional view taken along lines II-II of FIG. 1.

FIG. 1 is a perspective view of an alternating current type plasma display panel 10, and FIG. 2 is a cross-sectional view of the plasma display panel 10 taken along line II-II of FIG. 1. FIG. 2 includes a cross-sectional view taken along line II-II of a front substrate and a 90° rotated cross-sectional view taken along line II-II of a rear substrate.

Referring to FIGS. 1 and 2, an alternating current type plasma display panel 10 comprises a front substrate 11 on which an image is displayed and a rear substrate 21 facing the front substrate 11. Pairs of X electrodes 13 and Y electrodes 14 are disposed on the front substrate 11, and address electrodes 22 crossing the X and Y electrodes 13 and 14 are disposed on a surface of the rear substrate 21 facing the front substrate 11. The X electrodes 13 and the Y electrodes 14 on the front substrate 11 from a sustaining electrode pair 12. As depicted in FIG. 1, the sustaining electrode pair 12 is arranged of pairs of transparent electrodes made of a material such as Indium Tin Oxide (ITO), and bus electrodes 15 with a narrow width formed of a metal are disposed on a lower surface of the pairs of the transparent electrodes to reduce line resistance. Also, the sustaining electrode pair 12 can be formed of only the bus electrodes or the transparent electrodes. The sustaining electrode pair 12 composed of the X electrodes 13 and the Y electrodes 14 and the crossing address electrodes 22 is form a unit discharge cell.

A front dielectric layer 16 and a rear dielectric layer 26 are respectively arranged on each surface of the front substrate 11 having the X electrodes 13 and the Y electrodes 14 and the rear substrate 21 having the address electrodes 22. A protective layer 17 of MgO is arranged on the front dielectric layer 16, and a plurality of barrier ribs 27 that maintain a discharge distance and prevent electrical and optical cross-talk between the discharge cells are arranged on the rear dielectric layer 26. Red, green, and blue fluorescent materials 28 of colors are coated on both sides of the barrier ribs 27 and on an upper surface of the rear dielectric layer 26 on which the barrier ribs 27 are not arranged.

The plasma display panel having the above structure is operated in the following manner. When a discharge cell is selected, a predetermined voltage is applied to the address electrode 22 and the Y electrode 14 in the discharge cell to cause an address discharge between the two electrodes 22 and 14, and then, a wall charge is charged to the front dielectric layer 16. Afterward, when a predetermined voltage is applied between the X electrodes 13 and the Y electrodes 14, a sustaining discharge occurs in the discharge gas by migrating wall charges between the two electrodes 13 and 14 to generate ultraviolet rays, and an image is displayed from the fluorescent material 28 excited by the ultraviolet rays.

However, because the bus electrodes 15 are not arranged in the non-discharge region of the plasma display panel 10, the contrast is reduced due to the reflection of external light infiltrated into the plasma display panel 10 through a non-discharge region.

The present invention will now be described more fully with reference to the accompanying drawings in which exemplary embodiments of the present invention are shown. Like reference numerals in FIG. 1 refer to like elements throughout the drawings.

Figure 3:
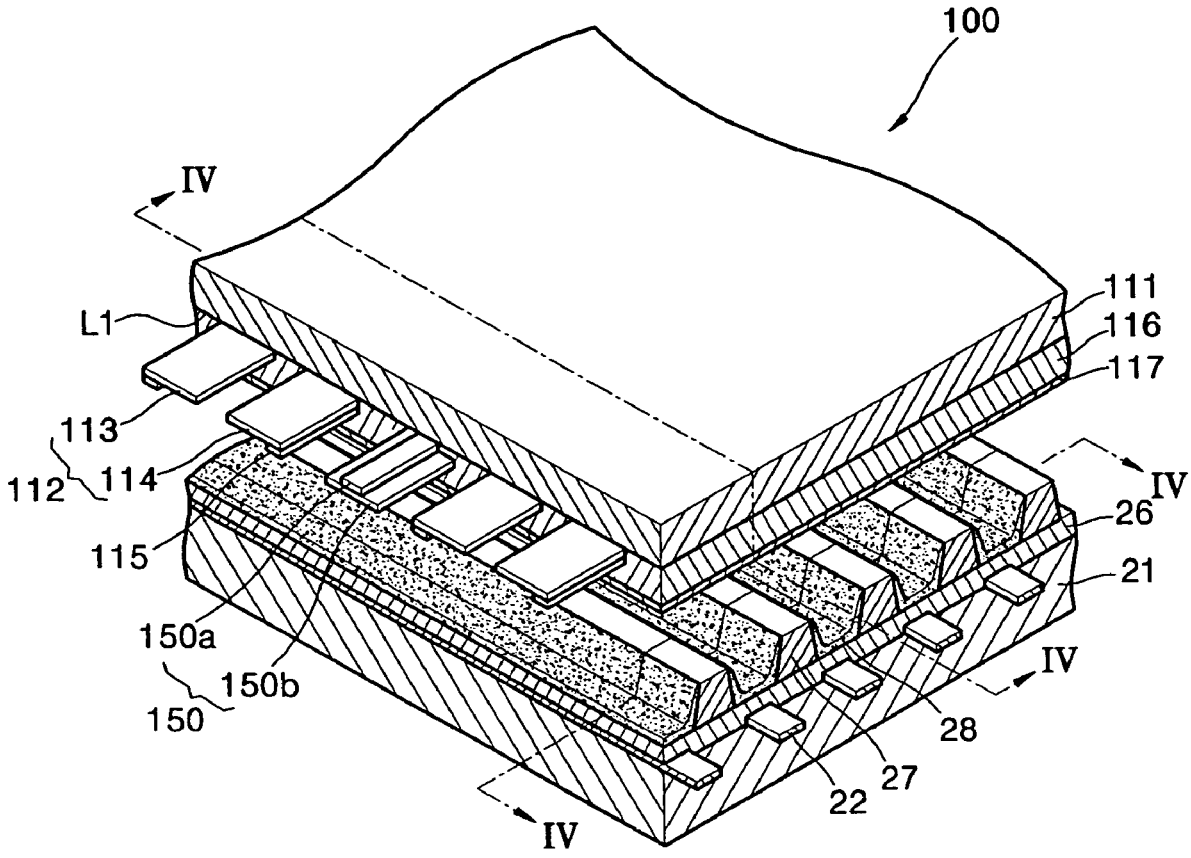
FIG. 3 is a perspective view of a plasma display panel according to a first embodiment of the present invention.

Referring to FIG. 3, a plasma display panel 100 according to a first embodiment of the present invention comprises a front substrate 111, sustain electrode pairs 112 composed of X electrodes 113 and Y electrodes 114, a front dielectric layer 116, a rear substrate 21, address electrodes 22, a rear dielectric layer 26, barrier ribs 27, and a fluorescent material 28.

The plasma display panel 100 according to the present invention can include a protective layer 117.

Address electrodes 22 that generate an address discharge and have a predetermined pattern, such as a stripe pattern, are disposed on a side surface of the rear substrate 21. The address electrodes 22 are covered by the rear dielectric layer 26. Barrier ribs 27 that define discharge cells and prevent cross-talk of charged electrons between cells are disposed on the rear dielectric layer 26. The barrier ribs 27 can be arranged parallel to the address electrodes 22 or can be arranged by forming second barrier ribs (not shown) to cross the first barrier ribs (not shown) and the address electrodes 22. The fluorescent material 28 is coated on the sides of the barrier ribs 27 and on an upper surface of the rear dielectric layer 26 which does not correspond to the barrier ribs 27.

On a lower surface of the front substrate 111, a plurality of sustain electrode pairs 112, composed of the X electrodes 113 and Y the electrodes 114 that generate a sustaining discharge, are arranged in each of the unit discharge cells. In FIG. 3, the bus electrodes 115 are arranged on a lower surface of the sustain electrode pairs 112, but the present invention is not limited thereto and the bus electrodes 115 can be omitted or the bus electrodes 115 can be the sustain electrode pairs 112 replacing the X electrodes 113 and the Y electrodes 114. The sustain electrode pairs 112 and the bus electrodes 115 are covered by the front dielectric layer 116.

A light absorption reflection film 150 is arranged between the adjacent sustain electrode pairs 112 on a lower surface L1 of the front substrate 111. The light absorption reflection film 150 includes a first light absorption reflection film 150*a* arranged on a lower surface of the front substrate 111 and a second light absorption reflection film 150*b* arranged on a lower surface of the first light absorption reflection film 150*a*. The first light absorption reflection film 150*a* and the second light absorption reflection film 150*b* have different widths. The contrast is increased by absorbing external light infiltrated into the plasma display panel 100 by the greater of the widths of the first light absorption reflection film 150*a* and the second light absorption reflection film 150*b*. The brightness is increased by reducing the absorption of visible light by the light absorption reflection film 150 by the difference between the width of the first light absorption reflection film 150*a* and the width of the second light absorption reflection film 150*b*.

Figure 4:
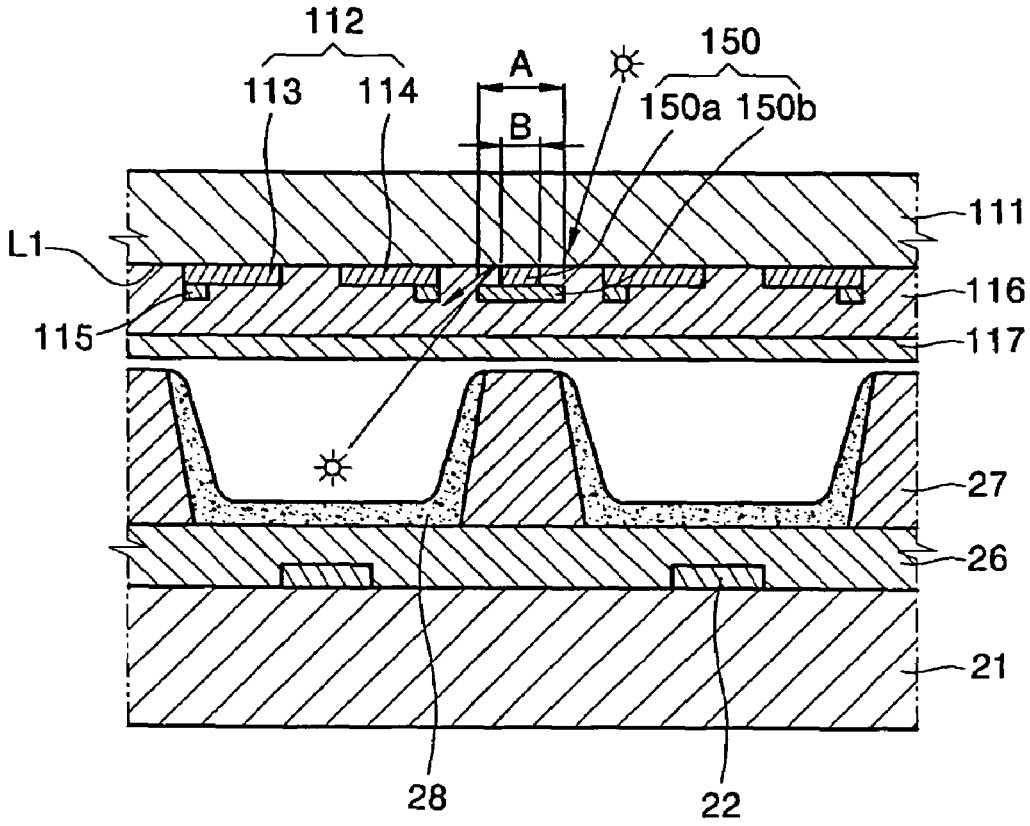
FIG. 4 is a cross-sectional view taken along line IV-IV of FIG. 3.

It is preferable that the first light absorption reflection film 150*a* and the second light absorption reflection film 150*b* are arranged to have a step difference because the above shaped light absorption reflection film 150 increases brightness and can also be manufactured easily. That is, as depicted in FIG. 4, when the first light absorption reflection film 150*a* has a narrow width and the second light absorption reflection film 150*b* has a wide width, a method of manufacturing the light absorption reflection film 150 includes forming a one-body light absorption reflection film having a width of the second light absorption reflection film on a lower surface L1 of the front substrate 111 and then undercutting the lower portion. The undercut portion becomes the first light absorption reflection film 150*a* and a part that is not undercut becomes the second light absorption reflection film 150*b*, thereby easily forming the first light absorption reflection film 150*a* and the second light absorption reflection film 150*b* having different widths.

As depicted in FIG. 4, the width of the first light absorption reflection film 150*a* can be narrower than the width of the second light absorption reflection film 150*b*. External light infiltrated into the plasma display panel 100 is absorbed by the width of the second light absorption reflection film 150*b*, thereby increasing contrast. On the other hand, the amount of visible light absorbed by the light absorption reflection film 150 is reduced due to the width difference between the first light absorption reflection film 150*a* and the second light absorption reflection film 150*b*, thereby increasing the brightness.

Figure 5:
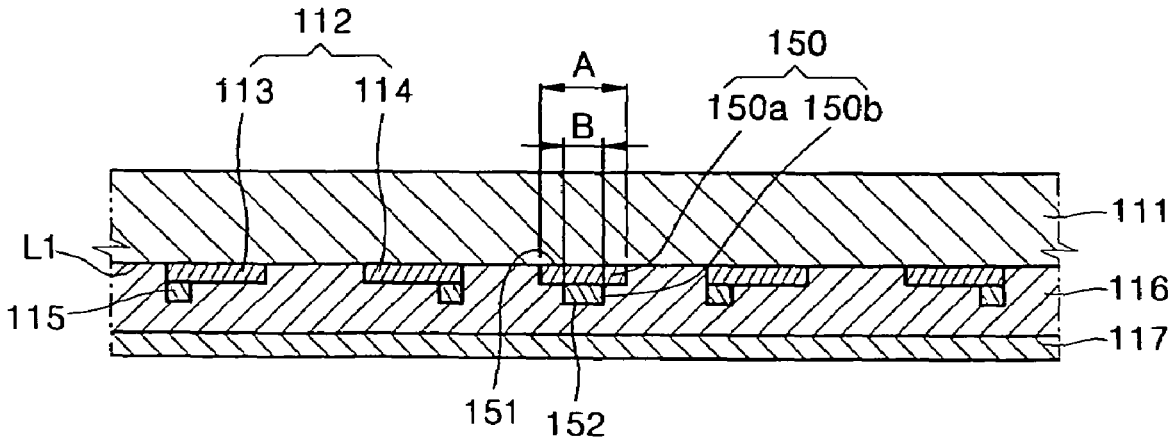
FIG. 5 is a cross-sectional view of a modified version of the front substrate of FIG. 4.

Unlike the above, as depicted in FIG. 5, the width of the first light absorption reflection film 150*a* can be wider than that of the second light absorption reflection film 150*b*. External light infiltrated into the plasma display panel 100 can be absorbed by the width of the first light absorption reflection film 150*a*, thereby increasing the contrast, and the absorbed amount of visible light generated by the discharge space is reduced by the space between the first light absorption reflection film 150*a* and the second light absorption reflection film 150*b*, thereby increasing the brightness.

Figure 6:
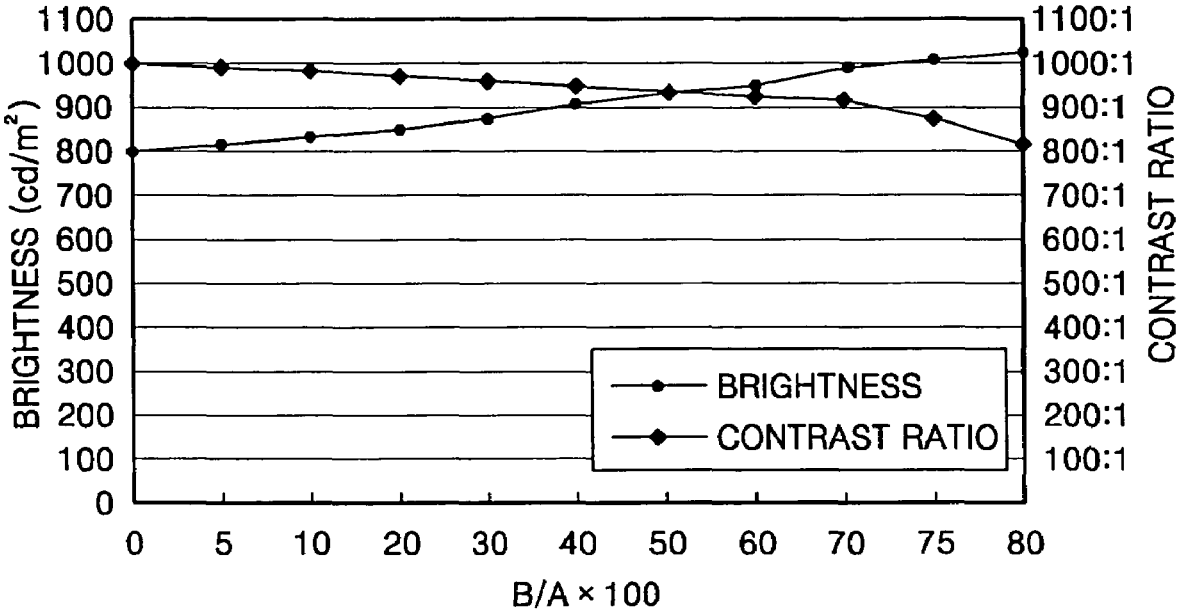
FIG. 6 is graph of variations in brightness and contrast according to (A−B)/A×100.

When the greater width between the first light absorption reflection film 150*a* and the second light absorption reflection film 150*b* is A, and the narrower width is B, a value of $(A-B)/A\times100$ is preferably in a range of 5~70. Referring to FIG. 6, the value of $(A-B)/A\times100$ indicates the difference in width between the first and the second light absorption reflection films 150*a* and 150*b*, and indicates that the value of $(A-B)/A\times100$ is proportional to the brightness and inversely proportional to the contrast. When the value of $(A-B)/A\times100$ is zero, that is, when the widths of the first and the second light absorption reflection films 150*a* and 150*b* are equal, the brightness is 800 cd/m$^2$ and the contrast is 1000:1. As the value of the $(A-B)/A\times100$ increases, the brightness gradually increases and the contrast ratio gradually decreases. However, when the value of $(A-B)/A\times100$ becomes greater than 70, an increasing rate of brightness is reduced and the contrast ratio decreases drastically. Therefore, the value of $(A-B)/A\times100$ is preferably in the range of 5-70. The brightness can be increased while sustaining the contrast ratio at 900:1.

It is preferable that the center line of the first and the second light absorption reflection films 150*a* and 150*b* are equal because the contrast and the brightness in each discharge cell are maintained uniform when the center line is equal.

Figure 7A:
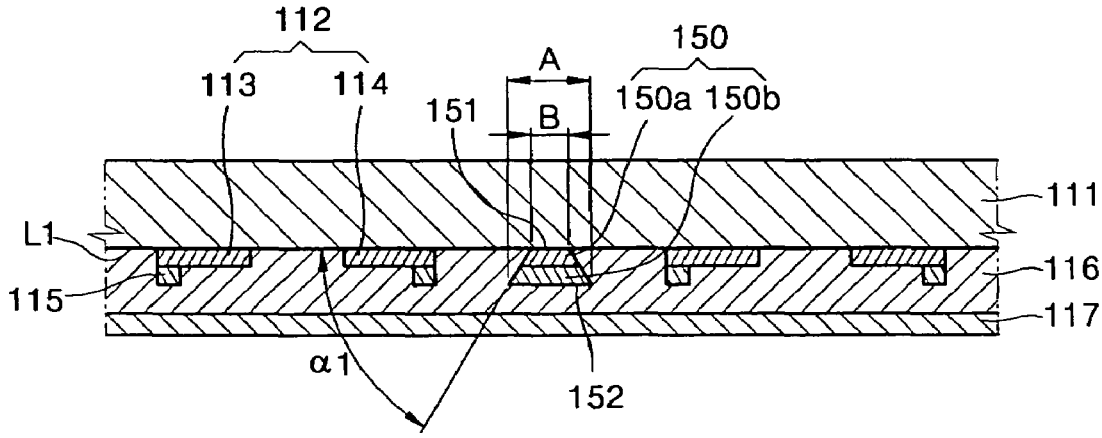
FIGS. 7A and 7B are cross-sectional views of other modified versions of the front substrate of FIG. 4.
Figure 7B:
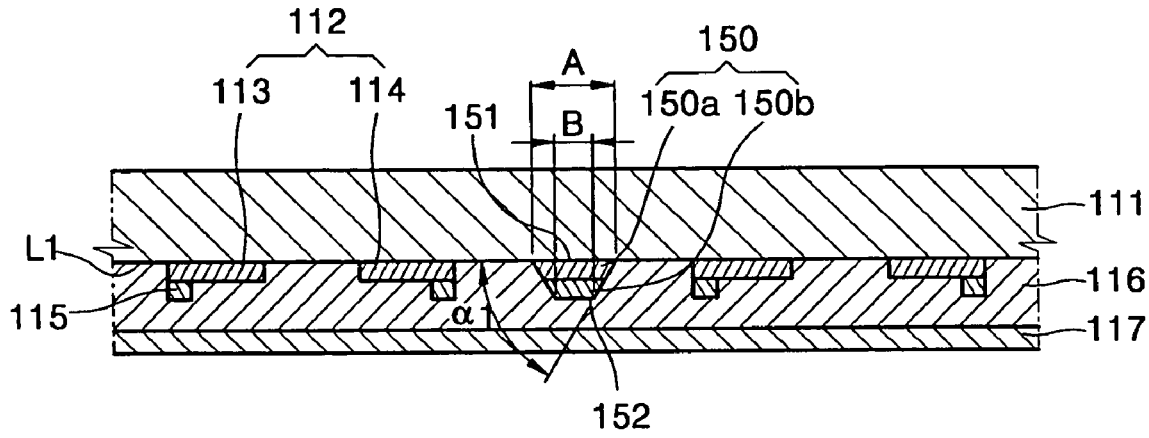

On the other hand, as depicted in FIG. 7A, the width of the light absorption reflection film 150 can be gradually increased from an upper surface 151 of the first light absorption reflection film 150*a* to a lower surface 152 of the second light absorption reflection film 150*b*, or as depicted in FIG. 7B, it can be a gradually decreasing shape. In any case, between the first and the second light absorption reflection films 150*a* and 150*b*, the wider film mainly functions to absorb external light, and the absorption of visible light emitted by the discharge cells is reduced by the space formed by the difference in width between the first and the second light absorption reflection films 150*a* and 150*b*, thereby maintaining a favorable contrast and brightness.

The side surfaces of the light absorption reflection film 150 have a slope angle of about 5-80° with respect to the lower surface L1 of the front substrate 111, and when the greater of the widths of the first and the second light absorption reflection films 150*a* and 150*b* is A, and the narrower width is B, the value of (A−B)/A×100 is preferably in a range of 5-70. That is, if the width of the light absorption reflection film 150 gradually increases from the upper surface 151 of the first light absorption reflection film 150*a* to the lower surface 152 of the second light absorption reflection film 150*b*, the maximum width of the second light absorption reflection film 150*b* becomes A and the minimum width of the first light absorption reflection film 150*a* becomes B.

It is preferable for the center lines of the first and the second light absorption reflection films 150*a* and 150*b* to be equal and black because black can absorb external light infiltrated into the plasma display panel 100. Therefore, a high contrast can be maintained.

Figure 8:
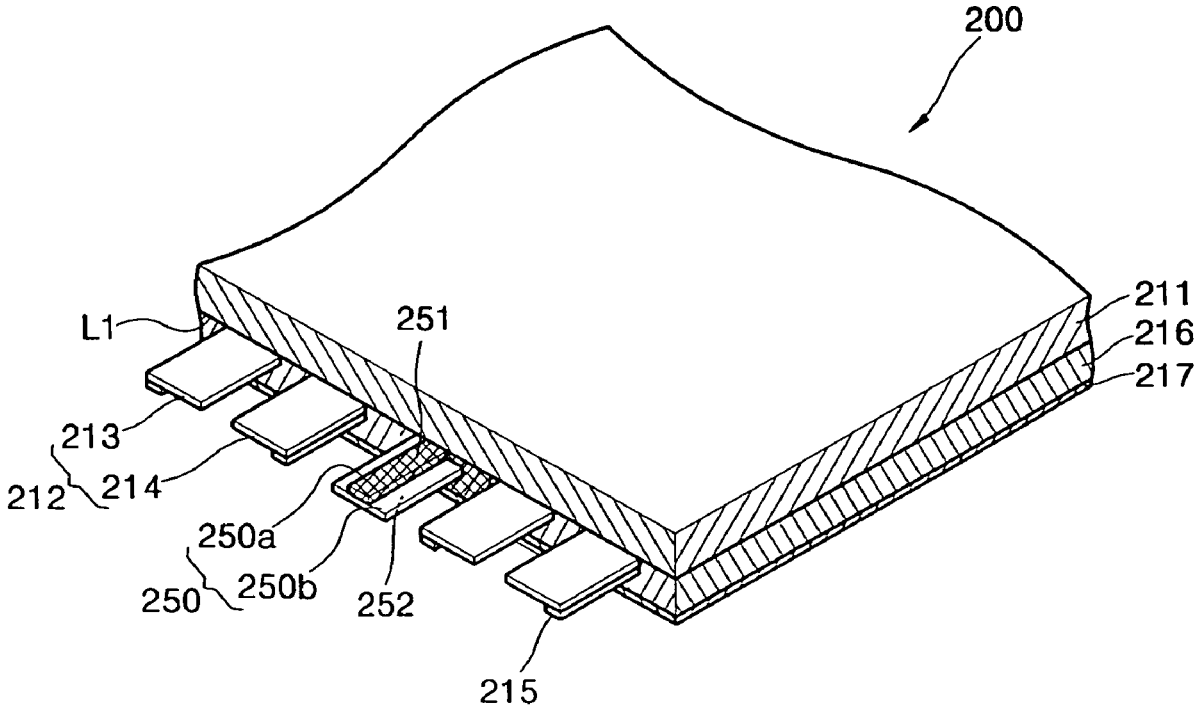
FIG. 8 is a perspective view of a plasma display panel according to a second embodiment of the present invention.

FIG. 8 is a perspective view of a plasma display panel 200 according to a second embodiment of the present invention. A rear substrate 21, address electrodes 22, a rear dielectric layer 26, barrier ribs 27, and fluorescent material 28 are not depicted since their structures and functions are the same as in FIG. 3, and a detailed description of these parts has also been omitted.

Referring to FIG. 8, the plasma display panel 200 comprises a front substrate 211, sustain electrode pairs 212 composed of X electrodes 213 and Y the electrodes 214, and a front dielectric layer 216. A protective layer 217 is provided. However, the present invention is not limited thereto and the present invention also includes a plasma display panel 200 without a protective layer. Bus electrodes 215 are arranged on a lower surface of the sustain electrode pairs 212 but the bus electrodes 215 can be omitted or the sustain electrode pairs 212 can be formed of only bus electrodes 215.

A light absorption reflection film 250 is arranged between two adjacent sustain electrode pairs 212. The light absorption reflection film 250 includes a first light absorption reflection film 250*a* arranged on a lower surface L1 of the front substrate 211 and a second light absorption reflection film 250*b* arranged on a lower surface of the first light absorption reflection film 250*a*.

Preferably, the first light absorption reflection film 250*a* and the second light absorption reflection film 250*b* have different widths. External light infiltrated into the plasma display panel 200 can be absorbed by the greater of the widths of the first and the second light absorption reflection films 250*a* and 250*b*, thereby increasing the contrast, and the absorption of visible light emitted by a discharge space is reduced by a space formed by the difference of the widths of the first and the second light absorption reflection films 250*a* and 250*b*, thereby increasing the brightness.

To further reflect the visible light by the light absorption reflection film 250, the second light absorption reflection film 250*b* preferably has a higher reflectance than that of the first light absorption reflection film 250*a* since the second light absorption reflection film 250*b* is disposed closer to the discharge space than the first light absorption reflection film 250*a*, i.e., farther from the outside than the first light absorption reflection film 250*a*. If the second light absorption reflection film 250*b* has a higher reflectance than the first light absorption reflection film 250*a*, the reflectance of the visible light emitted by the discharge space can be increased.

The first light absorption reflection film 250*a* and the second light absorption reflection film 250*b* can be arranged to have a stair shape having a step difference. As depicted in FIG. 4, the first light absorption reflection film 250*a* can be narrower than of the second light absorption reflection film 250*b*. Alternatively, as depicted in FIG. 5, the first light absorption reflection film 250*a* can be wider than the second light absorption reflection film 250*b*. In this manner, the brightness of the plasma display panel 200 is increased more than with a light absorption reflection film 250 without a step difference. The light absorption reflection film 250 can be formed by undercutting.

As depicted in FIGS. 4 and 5, when the greater of the widths of the first and the second light absorption reflection films 250*a* and 250*b* is A and the narrower width is B, the value of (A−B)/A×100 is preferably in a range of 5-70. As the value of (A−B)/A×100 increases, the brightness increases but the contrast decreases, and when the value of (A−B)/A×100 goes over 70, the contrast ratio is drastically reduced, resulting in lowering the performance of the plasma display panel 200.

The width of the light absorption reflection film 250 can gradually increase from the upper surface of the first light absorption reflection film 250*a* to the lower surface of the second light absorption reflection film 250*b* according to the first embodiment of the present invention as depicted in FIG. 7A, or can gradually decrease as the light absorption reflection film 150 depicted in FIG. 7B. The contrast is increased since the greater of the widths of the first and the second light absorption reflection films 250*a* and 250*b* absorb external light infiltrated into the plasma display panel 200, and the brightness is also increased by a reduction of the absorption of visible light emitted by the fluorescent material 28 because of the space formed between the difference in width of the first and the second light absorption reflection films 250*a* and 250*b*, thereby sustaining a higher contrast and brightness. The light absorption reflection film 250 depicted in FIG. 7B can be formed by undercutting.

Side surfaces of the light absorption reflection film 250 have a slope angle of about 5-80° with respect to the lower surface of the front substrate 211, and when the greater of the widths of the first and the second light absorption reflection films 250*a* and 250*b* is A and the narrower width is B, the value of (A−B)/A×100 is preferably in a range of 5-70. That is, if the width of the light absorption reflection film 250 gradually increases from the upper surface 251 of the first light absorption reflection film 250*a* to the lower surface 252 of the second light absorption reflection film 250*b*, the maximum width of the second light absorption reflection film 250*b* becomes A and the minimum width of the first light absorption reflection film 250*a* becomes B.

It is preferable for the center line of the first and the second light absorption reflection films 250*a* and 250*b* to be equal because the contrast and the brightness in each discharge cell are maintained uniform when the center line is equal.

The first light absorption reflection film 250*a* includes more than one metal selected from the group consisting of Ru, Mn, Ni, Cr, Fe, and Co, and the second light absorption reflection film 250*b* preferably includes $TiO_2$. The first light absorption reflection film 250*a* preferably includes oxides of Ru, Mn, Ni, Cr, Fe, and Co in a range of 2-80 wt % of total weight of the first light absorption reflection film 250*a*, and the second light absorption reflection film 250*b*, which is brighter than the first light absorption reflection film 250*a*, includes $TiO_2$ in a range of 2~98 wt % of total weight of the second light absorption reflection film 250*b*.

Furthermore, the first light absorption reflection film 250*a* is preferably black to increase the light absorption rate, and the second light absorption reflection film 250*b* is preferably white to increase the light reflectance.

Figure 9:
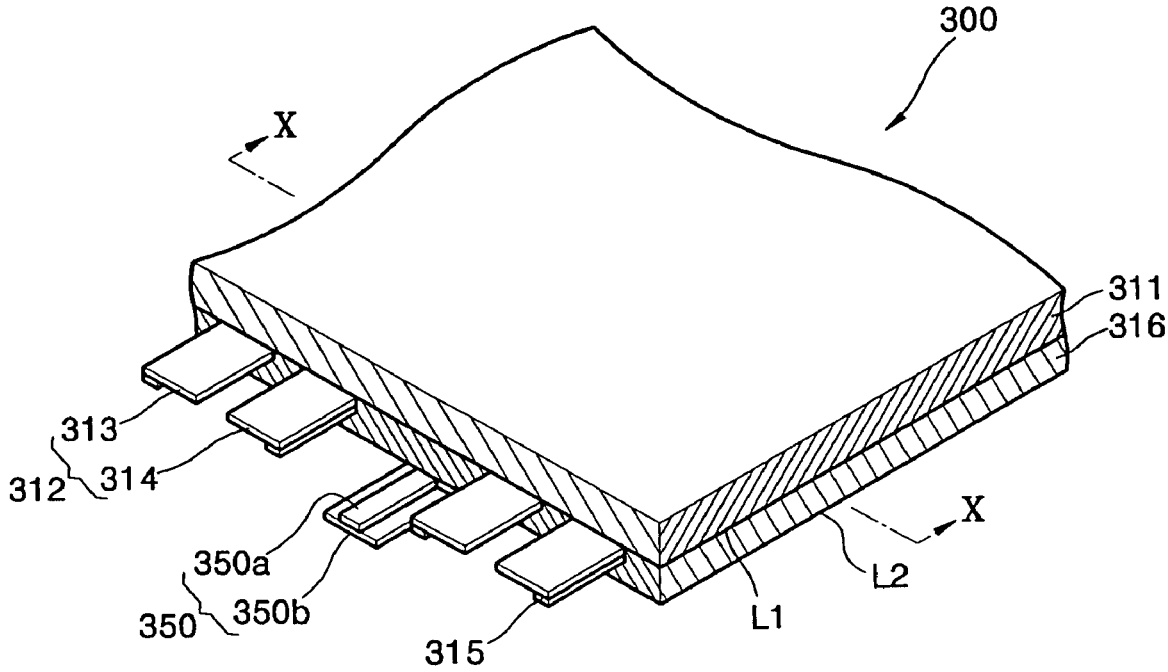
FIG. 9 is a perspective view of a plasma display panel according to a third embodiment of the present invention.

FIG. 9 is a perspective view of a plasma display panel 300 according to a third embodiment of the present invention. The rear substrate 21, the address electrodes 22, the rear dielectric layer 26, the barrier ribs 27, and the fluorescent material 28 are not shown since the structures and functions are identical to the plasma display panel 100 depicted in FIG. 3, and a detailed description thereof has been omitted.

Referring to FIG. 9, the plasma display panel 300 comprises a front substrate 311, sustain electrode pairs 312 composed of X electrodes 313 and Y the electrodes 314, and a front dielectric layer 316. Bus electrodes 315 are arranged on a lower surface of the sustain electrode pairs 312. However, the bus electrodes 315 can be omitted or the sustain electrode pairs 312 can be formed of only bus electrodes 315.

A light absorption reflection film 350 is arranged on a lower surface of the front dielectric layer 316. In FIG. 9, the light absorption reflection film 350 is arranged on the lower surface L2 of the front dielectric layer 316. However, the present invention is not limited thereto. A protective layer (not shown) can be arranged on a lower surface L2 of the front dielectric layer 316 and the light absorption reflection film 350 can be arranged on a lower surface of the protective layer, or alternatively, the light absorption reflection film 350 can be arranged on a lower surface L2 of the front dielectric layer 316 and the light absorption reflection film 350 can be covered by the protective layer (not shown).

The light absorption reflection film 350 includes a first light absorption reflection film 350*a* arranged on a lower surface L2 of the front dielectric layer 316 and a second light absorption reflection film 350*b* arranged on a lower surface of the first light absorption reflection film 350*a*. The first light absorption reflection film 350*a* and the second light absorption reflection film 350*b* have different widths. External light infiltrated into the plasma display panel 300 can be absorbed by the greater of the widths of the first and the second light absorption reflection films 350*a* and 350*b*, thereby increasing the contrast, and the absorption rate of the visible light emitted by a discharge space is reduced by a space formed by the width difference between the first and the second light absorption reflection films 250*a* and 250*b*, thereby increasing the brightness and maintaining an overall higher contrast and brightness.

Figure 10A:
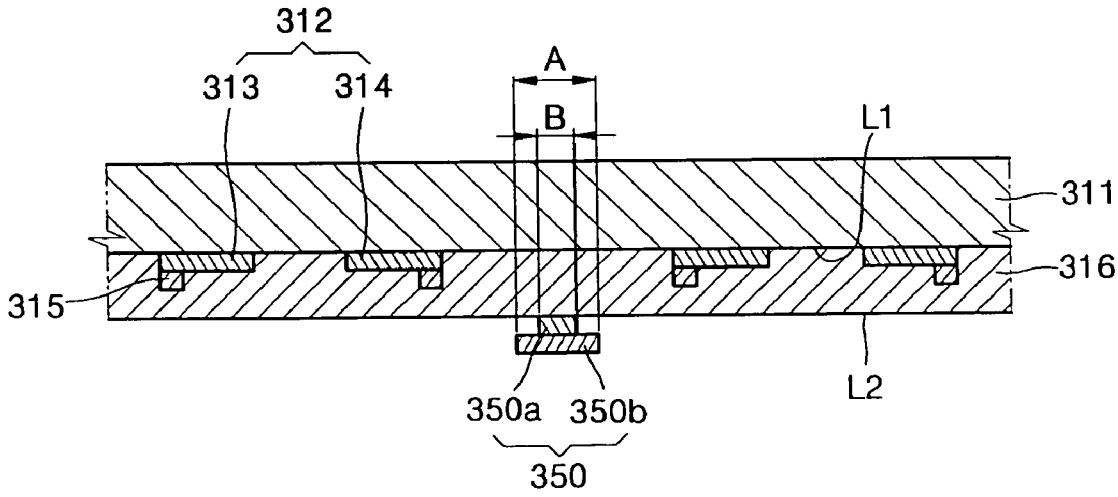
FIGS. 10A and 10B are cross-sectional views taken along lines X-X of FIG. 9.
Figure 10B:
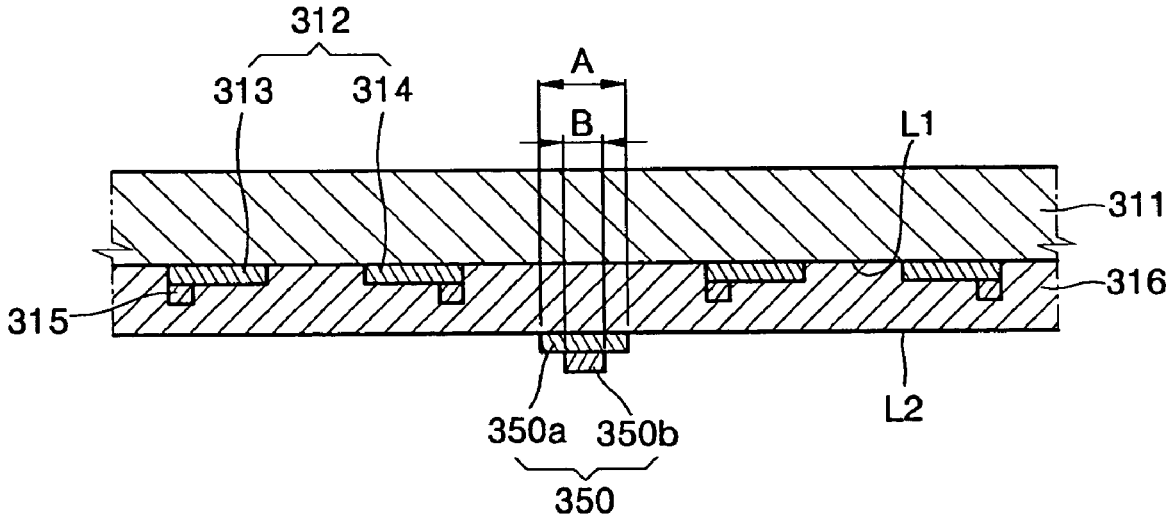

The first light absorption reflection film 350*a* and the second light absorption reflection film 350*b* can be formed to have a stair shape having a step difference. As depicted in FIGS. 10A and 10B, when the first light absorption reflection film 350*a* is narrower than the second light absorption reflection film 350*b*, manufacturing the light absorption reflection film 350 is simple. That is, a single-body light absorption reflection film 350 having the same width as the second light absorption reflection film 350*b* is arranged on a lower surface of the front dielectric layer 316, and a lower side thereof is undercut. The undercut portion becomes the first light absorption reflection film 350*a* and the portion that is not undercut becomes the second light absorption reflection film 350*b*. In this manner, the first light absorption reflection film 350*a* and the second light absorption reflection film 350*b* can be easily formed.

As depicted in FIG. 10A, the first light absorption reflection film 350*a* can be narrower than the second light absorption reflection film 350*b*. External light infiltrated into the plasma display panel 300 can be absorbed by the second light absorption reflection film 350*b*, thereby resulting in a favorable contrast ratio, and the amount of absorption of visible light emitted from the discharge space is reduced by the space formed by the width difference between the first light absorption reflection film 350*a* and the second light absorption reflection film 350*b*, thereby increasing the brightness.

On the other hand, the first light absorption reflection film 350*a* can be wider than the second light absorption reflection film 350*b*. The contrast ratio can be increased by the first light absorption reflection film 350*a* that absorbs external light infiltrated into the plasma display panel 300, and the brightness can be increased by the space that reduces the absorption of visible light emitted by the discharge space formed by the width difference between the first and second light absorption reflection films 350*a* and 350*b*.

When the greater of the widths of the first and the second light absorption reflection films 350*a* and 350*b* is A and the narrower width is B, the value of $(A-B)/A\times100$ is preferably in a range of 5-70. As shown in FIG. 6, the value of $(A-B)/A\times100$ is proportional to the brightness and inversely proportional to the contrast, i.e., as the value of $(A-B)/A\times100$ increases, the brightness increases but the contrast decreases, and when the value of $(A-B)/A\times100$ goes over 70, the contrast ratio is drastically reduced with respect to the increasing brightness.

It is preferable for center lines of the first and the second light absorption reflection films 350*a* and 350*b* to be equal because the contrast and brightness in each discharge cell can be maintained uniform when the center lines are equal.

Figure 11A:
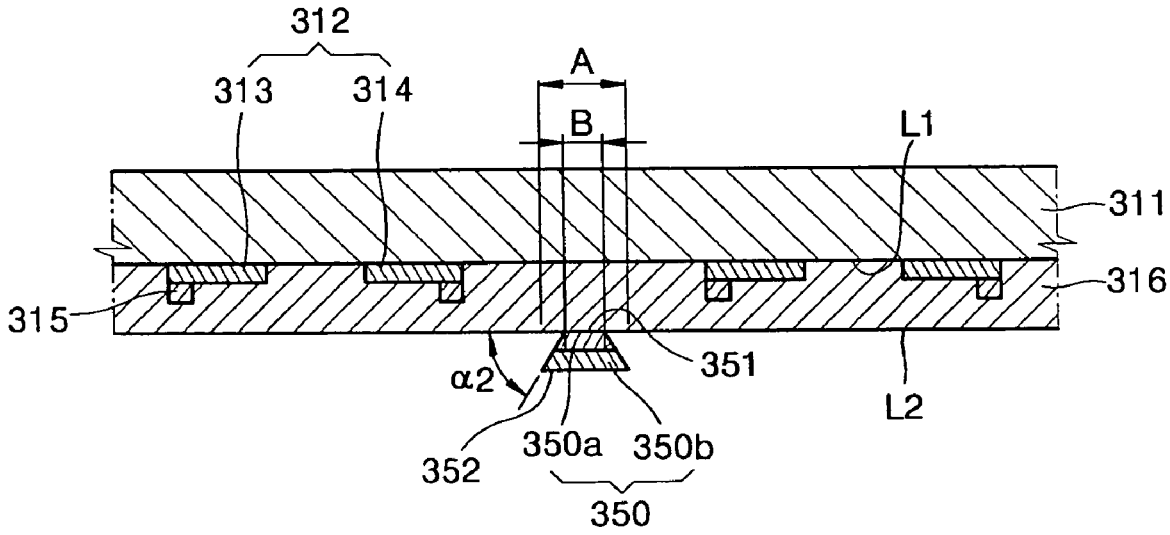
FIGS. 11A and 11B are cross-sectional views of modified versions of the front substrate of FIG. 10A.
Figure 11B:
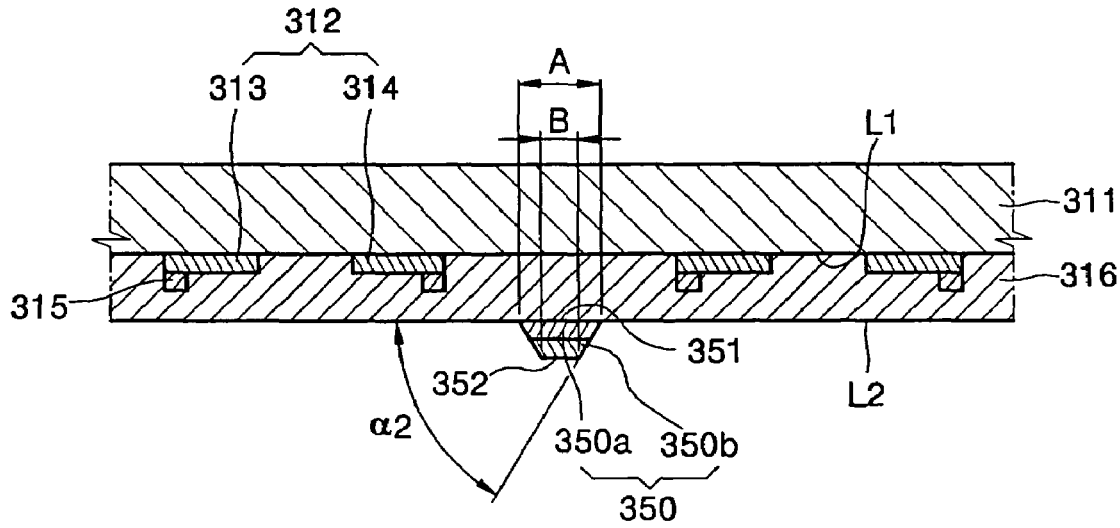

As depicted in FIG. 11A, the width of the light absorption reflection film 350 can gradually increase from an upper surface of the first light absorption reflection film 350*a* to a lower surface of the second light absorption reflection film 350*b*, or as depicted in FIG. 11B, can gradually decrease. The plasma display panel 300 maintains a favorable contrast because the greater of the widths of the first and the second light absorption reflection films 350*a* and 350*b* absorbs external light infiltrated from the outside, and the brightness also is increased since the absorption of visible light emitted by the fluorescent material 28 is reduced by the space formed between the width difference of the first and the second light absorption reflection films 350*a* and 350*b*, thereby sustaining a higher contrast and brightness.

Side surfaces of the light absorption reflection film 350 have a slope angle of about 5-80° with respect to the upper surface L2 of the front dielectric layer 316, and when the greater of the widths of the first and the second light absorption reflection films 350*a* and 350*b* is A and the narrower width is B, the value of $(A-B)/A\times100$ is preferably in a range of 5-70.

That is, if the width of the light absorption reflection film 350 gradually increases from the upper surface 351 of the first light absorption reflection film 350*a* to the lower surface 352 of the second light absorption reflection film 350*b*, the maximum width of the second light absorption reflection film 350*b* becomes A and the minimum width of the first light absorption reflection film 350*a* becomes B. Preferably, the light absorption reflection film 350 depicted in FIG. 11A is formed by undercutting.

It is preferable for the center lines of the first and the second light absorption reflection films 350*a* and 350*b* to be equal because the contrast and brightness in each discharge cell can be maintained uniform when the center lines are equal.

The first and the second light absorption reflection films 350*a* and 350*b* are preferably formed of the same material and are black to maintain a high contrast ratio by absorbing incident light from the outside.

Figure 12:
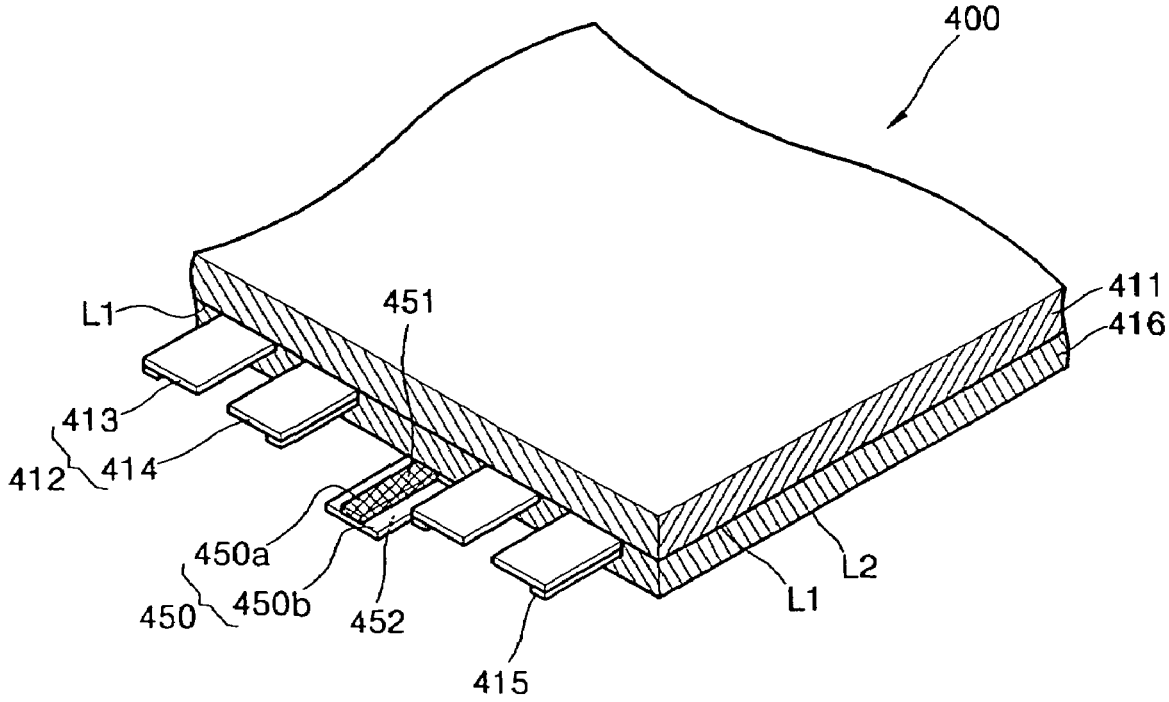
FIG. 12 is a perspective view of a plasma display panel according to a fourth embodiment of the present invention.

FIG. 12 is a perspective view of a plasma display panel 400 according to a fourth embodiment of the present invention. The rear substrate 21, the address electrodes 22, the rear dielectric layer 26, the barrier ribs 27, and the fluorescent material 28 are not shown since the structures and functions are identical to the plasma display panel 100 depicted in FIG. 3, and a detailed description thereof has been omitted.

Referring to FIG. 12, the plasma display panel 400 comprises a front substrate 411, sustain electrode pairs 412 composed of X electrodes 413 and Y the electrodes 414, and a front dielectric layer 416. In FIG. 12, the light absorption reflection film 450 is arranged on a lower surface L2 of the front dielectric layer 416. However, the present invention is not limited thereto, and a protective layer (not shown) can be arranged on a lower surface L2 of the front dielectric layer 416 and the light absorption reflection film 450 can be arranged on the protective layer. Alternatively, the light absorption reflection film 450 can be arranged on a lower surface L2 of the front dielectric layer 416 and the protective layer can cover the light absorption reflection film 450. Also, bus electrodes 315 are arranged on a lower surface of transparent electrode pairs 413 and 414. However, the present invention is not limited thereto, and the sustain electrode pairs 312 can be formed of only bus electrodes 315.

A light absorption reflection film 450 is arranged between the two sustain electrode pairs 412. The light absorption reflection film 450 comprises a first light absorption reflection film 450*a* arranged under the front dielectric layer 416 and a second light absorption reflection film 450*b* stacked on the first light absorption reflection film 450*a*.

The first light absorption reflection film 450*a* and the second light absorption reflection film 450*b* have different widths. The contrast can be increased by absorbing external light infiltrated into the plasma display panel 400 by the greater of the widths of the first light absorption reflection film 450*a* and the second light absorption reflection film 450*b*. The brightness can also be increased by reducing the absorption of the visible light emitted by the discharge space by a space formed by the width difference between the first and second light absorption reflection film 450*a* and 450*b*.

To further reflect the visible light by the light absorption reflection film 450, the second light absorption reflection film 450*b* preferably has a higher reflectance than that of the first light absorption reflection film 450*a*. The second light absorption reflection film 450*b* is disposed closer to the discharge space than the first light absorption reflection film 450*a*. If the second light absorption reflection film 450*b* has a higher reflectance than the first light absorption reflection film 450*a*, then the reflectance of the visible light emitted from the discharge space is increased.

The first light absorption reflection film 450*a* and the second light absorption reflection film 450*b* can be formed to have a stair shape having a step difference. As depicted in FIG. 4, the width of the first light absorption reflection film 450*a* can be narrower than the width of the second light absorption reflection film 450*b* according to the first embodiment of the present invention. Alternatively, the width of the first light absorption reflection film 450*a* can be greater than that of the second light absorption reflection film 250*b* as depicted in FIG. 5. As a result, in the space formed by the width difference, the light absorption by the light absorption reflection film 450 is reduced. Therefore, the brightness can be increased by forming the second light absorption reflection film 450*b* with a higher light reflectance material than the first light absorption reflection film 450*a* and with the step difference between the first and the second light absorption reflection films 450*a* and 450*b*.

As depicted in FIGS. 4 and 5, when the greater of the width of the first light absorption reflection film 450*a* and the width of the second light absorption reflection film 450*b* is A and the narrower width is B, the value of (A−B)/A×100 is preferably in a range of 5-70. As depicted in FIG. 6, as the value of (A−B)/A×100 increases, the brightness increases but the contrast ratio decreases, and when the value of (A−B)/A×100 goes over 70, the contrast ratio decreases drastically.

Also, the light absorption reflection film 450, as the light absorption reflection film 150 employed in the plasma display panel according to the first embodiment of the present invention, can gradually increase from an upper surface 451 of the first light absorption reflection film 450*a* to a lower surface 452 of the second light absorption reflection film 450*b*, or alternatively, can gradually decrease like the light absorption reflection film 150 depicted in FIG. 7B. The greater of the two widths of the first and second light absorption reflection films 450*a* and 450B absorbs external light infiltrated into the plasma display panel 400, thereby maintaining a favorable contrast ratio, and a space formed by the difference between the widths of the first and second light absorption reflection films 450*a* and 450B reduces the absorption of visible light emitted from the discharge space, thereby increasing the brightness.

Side surfaces of the light absorption reflection film 450 have a slope angle of about 5-80° with respect to the front dielectric layer 416, and when the greater of the widths of the first and second light absorption reflection films 450*a* and 450*b* is A and the narrower width is B, the value of (A−B)/A×100 is preferably in a range of 5-70. That is, if the width of the light absorption reflection film 450 gradually increases from an upper surface 451 of the first light absorption reflection film 450*a* to a lower surface 152 of the second light absorption reflection film 450*b*, the maximum width of the second light absorption reflection film 450*b* becomes A and the minimum width of the first light absorption reflection film 450*a* becomes B.

It is preferable for center lines of the first and the second light absorption reflection films 450*a* and 450*b* to be equal because uniform contrast and brightness in each discharge cell can be maintained when the center lines are equal.

The first light absorption reflection film 450*a* includes more than one metal selected from the group consisting of Ru, Mn, Ni, Cr, Fe, and Co, and the second light absorption reflection film 450*b* preferably includes $TiO_2$. The first light absorption reflection film 450*a* preferably includes oxides of Ru, Mn, Ni, Cr, Fe, and Co in a range of 2-80 wt % of total weight of the first light absorption reflection film 450*a*, and the second light absorption reflection film 450*b* includes $TiO_2$, which is brighter than the first light absorption reflection film 450*a*, in a range of 2-98 wt % of total weight of the second light absorption reflection film 450*b*.

Furthermore, the first light absorption reflection film 450*a* is preferably black to increase the light absorption rate, and the second light absorption reflection film 450*b* is white to increase the light reflectance.

Figure 13:
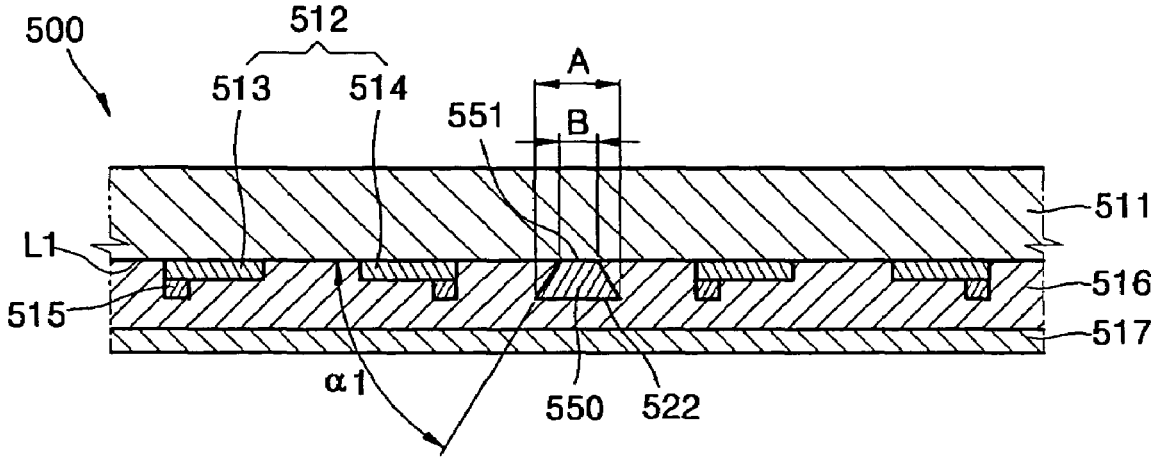
FIG. 13 is a cross-sectional view of a front substrate of a plasma display panel according to a fifth embodiment of the present invention.

FIG. 13 is a cross-sectional view of a plasma display panel 500 according to a fifth embodiment of the present invention. Referring to FIG. 13, a light absorption reflection film 550 is arranged on a lower surface L1 of the front substrate 511 and an upper surface 551 that contacts the front substrate 511 of the light absorption reflection film 550 is narrower than a lower surface 552 by being undercut. Detailed descriptions of other components except for the light absorption reflection film 550 have been omitted since the other components are identical to the components in the plasma display panel according to the first and second embodiments of the present invention.

The undercutting can be performed in the process of forming the light absorption reflection film 550. That is, while forming the light absorption reflection film 550, a light exposure process is performed. While exposing a light, a bridge reaction occurs from the lower surface 552 of the light absorption reflection film 550. Since a sufficient bridge reaction is performed on the lower surface 552 of the light absorption reflection film 550, the penetration of etching liquid or developing liquid during etching or developing after the bridge reaction is small. On the other hand, a high penetration of etching liquid or developing liquid to the upper surface of the light absorption reflection film 550 occurs during etching or developing because there is no sufficient bridge reaction relative to the lower surface 551.

Accordingly, since the degree of penetration of the etching liquid or developing liquid into the upper surface 551 is greater than that of the lower surface 552 of the light absorption reflection film 550, an undercutting of an inverse trapezoidal shape from the lower surface 552 to the upper surface 551 is formed. That is, a light absorption reflection film 550 having a narrower width of an upper surface and a greater width of a lower surface is formed. The amount of undercutting can be controlled during the etching or developing.

By controlling the amount of undercutting during the formation of the light absorption reflection film 550, the width of the upper surface 551 can easily be controlled to be narrower than the that of the lower surface 52.

Side surfaces of the light absorption reflection film 550 have a slope angle a1 of about 5-80° with respect to the upper surface L1 of the front substrate 511, and when the lower surface 552 is A, and the upper surface 551 is B, the value of (A−B)/A×100 is preferably in a range of 5-70.

The light absorption reflection film 550 can be formed as a stack of layers. That is, if the plasma display panel 500 is the same as the plasma display panel 200 according to the second embodiment of the present invention, the light absorption reflection film 550 can be formed to be undercut after depositing the first light absorption reflection film 550*a* on the front substrate 511 by then depositing the second light absorption reflection film 550*b* with a higher reflectance than the first light absorption reflection film 550*a*.

Alternatively, as depicted in FIG. 13, if the light absorption reflection film 550 is formed in a single layer, it can be an undercut that is gradually increased from the lower surface 552 to the upper surface 551. That is, if the light absorption reflection film 150 is employed in the plasma display panel 100 according to the first embodiment of the present invention, then the first light absorption reflection film 150*a* and the second light absorption reflection film 150*b* can be formed of an identical material. The light absorption reflection film can be formed as a single layer and undercut for process convenience.

Figure 14:
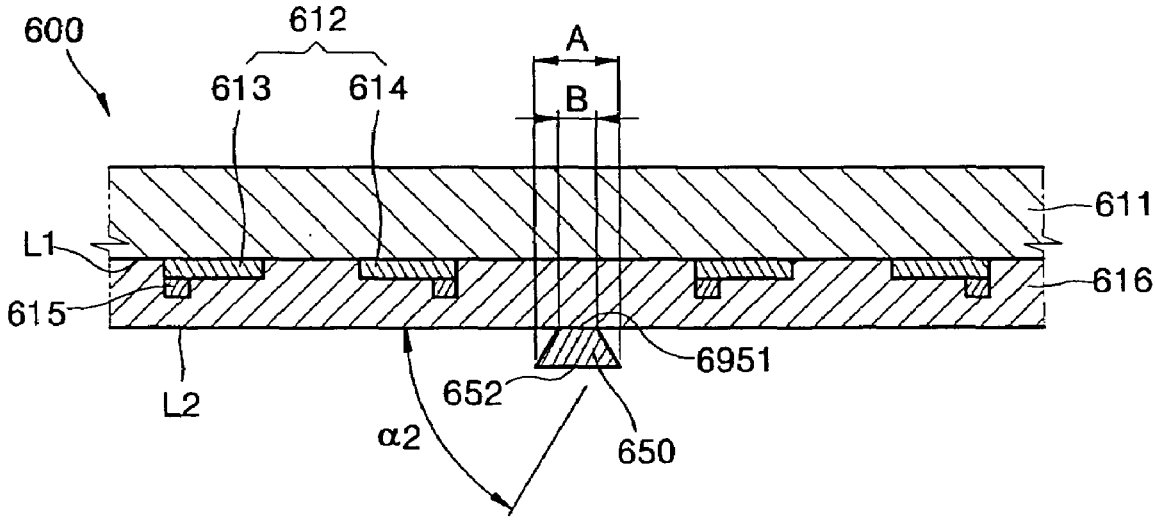
FIG. 14 is a cross-sectional view of a front substrate of a plasma display panel according to a sixth embodiment of the present invention.

FIG. 14 is a cross-sectional view of a light absorption reflection film 650 employed in a plasma display panel 600 according to a sixth embodiment of the present invention. The light absorption reflection film 650 is arranged between adjacent sustain electrode pairs 612 on a lower surface of a front dielectric layer 616, and the width of an upper surface 651 that contacts the front dielectric layer 616 is formed to be narrower than that of a lower surface 652 by under cutting. Detailed descriptions of the components of the plasma display panel 600 except for the light absorption reflection film 650 have been omitted since the components are identical to the components employed in the plasma display panels of the first and second embodiments of the present invention. Also, a detailed description of the process of forming the undercut has also been omitted since it is identical to the process of forming the light absorption reflection film 550 employed in the plasma display panel 500 according to the present invention.

Preferably, side surfaces of the light absorption reflection film 650 have a slope angle a2 of about 5-80° with respect to the lower surface L2 of the front dielectric layer 616, and when the greater of the widths of the first and the second light absorption reflection films 650*a* and 650*b* is A and the narrower width is B, the value of (A−B)/A×100 is preferably in a range of 5-70.

When the light absorption reflection film 650 is the same as the light absorption reflection film 450 employed in the plasma display panel 400 according to the fourth embodiment of the present invention, it is preferably formed of multiple layers. However, when the light absorption reflection film 650 is the same as the light absorption reflection film 350 employed in the plasma display panel 300 according to the third embodiment of the present invention, the first light absorption reflection film 350*a* and the second light absorption reflection film 350*b* can be formed of the same material. The light absorption reflection film can be formed of a single layer and undercut for process convenience.

According to the present invention, a light absorption reflection film having the above structure, arranged in a non-discharge region of a plasma display panel, provides a sufficient width to absorb external light infiltrated into the plasma display panel from the outside and a high reflectance of visible light emitted by the discharge space, thereby increasing the brightness while maintaining at favorable contrast.

While the present invention has been particularly shown and described with reference to exemplary embodiments thereof, it will be understood by those of ordinary skill in the art that various changes in form and details can be made therein without departing from the spirit and scope of the present invention as recited in the following claims.

What is claimed is:

1. A plasma display panel comprising:

a rear substrate;

a plurality of address electrodes arranged on a surface of the rear substrate;

a rear dielectric layer arranged on the rear substrate to cover the address electrodes;

a plurality of barrier ribs adapted to define discharge cells, the plurality of barrier ribs arranged on an upper portion of the rear dielectric layer;

a fluorescent material adapted to coat an inner surface of the discharge cells;

a front substrate arranged to face the rear substrate;

a plurality of sustain electrode pairs, each pair composed of X and Y electrodes adapted to form unit discharge cells and to cross the address electrodes and arranged on a lower surface of the front substrate;

a light absorption reflection film including a first light absorption reflection film arranged between adjacent sustain electrode pairs on a lower surface of the front substrate and a second light absorption reflection film having a different width than that of the first light absorption reflection film, the second light absorption reflection film arranged on a lower surface of the first light absorption reflection film; and a front dielectric layer arranged on a lower surface of the front substrate to cover the X and Y electrodes and the light absorption reflection film;

wherein the first light absorption reflection film and the second light absorption reflection film are arranged to have a stair shape having a step difference; and wherein when the greater of the widths of the first and second light absorption reflection films is A and the narrower width is B, a value of (A−B)/A×100 is in a range of 5-70.

2. A plasma display panel comprising:

a rear substrate;

a plurality of address electrodes arranged on a surface of the rear substrate;

a rear dielectric layer arranged on the rear substrate to cover the address electrodes;

a plurality of barrier ribs adapted to define discharge cells, the plurality of barrier ribs arranged on an upper portion of the rear dielectric layer;

a fluorescent material adapted to coat an inner surface of the discharge cells;

a front substrate arranged to face the rear substrate;

a plurality of sustain electrode pairs, each pair composed of X and Y electrodes adapted to form unit discharge cells and to cross the address electrodes and arranged on a lower surface of the front substrate;

a light absorption reflection film including a first light absorption reflection film arranged between adjacent sustain electrode pairs on a lower surface of the front substrate and a second light absorption reflection film having a different width than that of the first light absorption reflection film, the second light absorption reflection film arranged on a lower surface of the first light absorption reflection film; and a front dielectric layer arranged on a lower surface of the front substrate to cover the X and Y electrodes and the light absorption reflection film;

wherein a width of the light absorption reflection film is gradually increased from an upper surface of the first light absorption reflection film to a lower surface of the second light absorption reflection film.

3. The plasma display panel of claim 2, wherein side surfaces of the light absorption reflection film have a slope angle in a range of 5-80° with respect to the lower surface of the front substrate, and when the greater of the widths of the first and the second light absorption reflection films is A, and the narrower width is B, the value of (A−B)/A×100 is in a range of 5-70.

4. The plasma display panel of claim 2, wherein center lines of the first light absorption reflection film and the second light absorption reflection film are equal.

5. The plasma display panel of claim 2, wherein the first and second light absorption reflection films are black.

6. A plasma display panel comprising:

a rear substrate;

a plurality of address electrodes arranged on a surface of the rear substrate;

a rear dielectric layer arranged on the rear substrate to cover the address electrodes;

a plurality of barrier ribs adapted to define discharge cells, the plurality of barrier ribs arranged on an upper portion of the rear dielectric layer;

a fluorescent material adapted to coat an inner surface of the discharge cells;

a front substrate arranged to face the rear substrate;

a plurality of sustain electrode pairs, each pair composed of X and Y electrodes adapted to form unit discharge cells and to cross the address electrodes and arranged on a lower surface of the front substrate;

a light absorption reflection film including a first light absorption reflection film arranged between adjacent sustain electrode pairs on a lower surface of the front substrate and a second light absorption reflection film having a different width than that of the first light absorption reflection film and composed of a material having a higher reflectance than that of the first light absorption reflection film, the second light absorption reflection film arranged on a lower surface of the first light absorption reflection film; and a front dielectric layer arranged on a lower surface of the front substrate to cover the X and Y electrodes and the light absorption reflection film;

wherein the first light absorption reflection film and the second light absorption reflection film are arranged to have a stair shape having a step difference; and wherein when the greater of the widths of the first and second light absorption reflection films is A and the narrower width is B, a value of (A−B)/A×100 is in a range of 5-70.

7. A plasma display panel comprising:

a rear substrate;

a plurality of address electrodes arranged on a surface of the rear substrate;

a rear dielectric layer arranged on the rear substrate to cover the address electrodes;

a plurality of barrier ribs adapted to define discharge cells, the plurality of barrier ribs arranged on an upper portion of the rear dielectric layer;

a fluorescent material adapted to coat an inner surface of the discharge cells;

a front substrate arranged to face the rear substrate;

a plurality of sustain electrode pairs, each pair composed of X and Y electrodes adapted to form unit discharge cells and to cross the address electrodes and arranged on a lower surface of the front substrate;

a light absorption reflection film including a first light absorption reflection film arranged between adjacent sustain electrode pairs on a lower surface of the front substrate and a second light absorption reflection film having a different width than that of the first light absorption reflection film and composed of a material having a higher reflectance than that of the first light absorption reflection film, the second light absorption reflection film arranged on a lower surface of the first light absorption reflection film; and a front dielectric layer arranged on a lower surface of the front substrate to cover the X and Y electrodes and the light absorption reflection film;

wherein a width of the light absorption reflection film is gradually increased from an upper surface of the first light absorption reflection film to a lower surface of the second light absorption reflection film.

8. The plasma display panel of claim 7, wherein side surfaces of the light absorption reflection film have a slope angle in a range of 5~80° with respect to the lower surface of the front substrate, and when the greater of the widths of the first and the second light absorption reflection films is A, and the narrower width is B, the value of (A−B)/A×100 is in a range of 5-70.

9. The plasma display panel of claim 7, wherein center lines of the first light absorption reflection film and the second light absorption reflection film are equal.

10. The plasma display panel of claim 7, wherein the first light absorption reflection film includes more than one metal selected from the group consisting of Ru, Mn, Ni, Cr, Fe, and Co, and the second light absorption reflection film includes $TiO_2$.

11. The plasma display panel of claim 7, wherein the first light absorption reflection film is black and the second light absorption reflection film is white.

12. A plasma display panel comprising:

a rear substrate;

a plurality of address electrodes arranged on a surface of the rear substrate;

a rear dielectric layer arranged on the rear substrate to cover the address electrodes;

a plurality of barrier ribs adapted to define discharge cells, the plurality of barrier ribs arranged on an upper portion of the rear dielectric layer;

a fluorescent material adapted to coat an inner surface of the discharge cells;

a front substrate arranged to face the rear substrate;

a plurality of sustain electrode pairs, each pair composed of X and Y electrodes adapted to form unit discharge cells and to cross the address electrodes and arranged on a lower surface of the front substrate;

a light absorption reflection film undercut such that a width of a lower surface is narrower than that of an upper surface contacting the front substrate, the light absorption reflection film arranged between adjacent sustain electrode pairs on a lower surface of the front substrate; and a front dielectric layer arranged on a lower surface of the front substrate to cover the X and Y electrodes and the light absorption reflection film;

wherein side surfaces of the light absorption reflection film have a slope angle in a range of 5-80° with respect to the lower surface of the front substrate, and when the lower surface of the light absorption reflection films is A and the upper surface of the light absorption reflection film is B, the value of (A−B)/A×100 is in a range of 5-70.

13. The plasma display panel of claim 12, wherein the light absorption reflection film is a single layer undercut such that a width of the light absorption reflection film is gradually decreased from an upper surface of the light absorption reflection film to a lower surface of the light absorption reflection film.

* * * * *